United States Patent [19]

Timperi et al.

[11] Patent Number: 4,877,368

[45] Date of Patent: Oct. 31, 1989

[54] FLUIDIZING CENTRIFUGAL PUMP

[75] Inventors: Jukka Timperi; Reijo Vesala, both of Kotka; Vesa Vikman, Kymi, all of Finland

[73] Assignee: A. Ahlstrom Corporation, Finland

[21] Appl. No.: 268,599

[22] Filed: Nov. 8, 1988

[51] Int. Cl.[4] ..... F04D 13/12

[52] U.S. Cl. ..... 415/143; 415/72; 366/156

[58] Field of Search ..... 415/143, 121 B, 71–74; 416/176, 177, 194, 195; 366/154–156, 157, 164, 169

[56] References Cited

U.S. PATENT DOCUMENTS

| | | | |
|---|---|---|---|
| 2,498,143 | 2/1950 | Struckmann | 415/143 |
| 2,659,311 | 11/1953 | Schaffer | 415/143 |
| 4,256,035 | 3/1981 | Neufeldt | 366/156 |
| 4,435,122 | 3/1984 | Niskanen et al. | 415/121 B |
| 4,619,736 | 10/1986 | Henricson et al. | 415/121 B |
| 4,770,604 | 9/1988 | Luthi et al. | 415/143 |

FOREIGN PATENT DOCUMENTS

| | | | |
|---|---|---|---|
| WO87/00448 | 1/1987 | PCT Int'l Appl. | 366/156 |
| 687266 | 9/1979 | U.S.S.R. | 415/143 |

*Primary Examiner*—Robert E. Garrett
*Assistant Examiner*—John T. Kwon
*Attorney, Agent, or Firm*—Cohen, Pontani & Lieberman

[57] ABSTRACT

A fluidizing centrifugal pump for medium to high consistency fiber suspension includes a housing having an inlet channel and an outlet and an impeller operatively rotatable about the pump axis. The impeller has a working vane and at least a blade extending substantially axially from the working vane and disposed in the inlet channel for fluidizing suspension which is received in the pump inlet. A feeding vane, preferably in the form of a spiral thread, is disposed in the inlet channel, radially-outwardly from the fluidizing blade and extending along at least a portion of the axial extension of the blade. The feeding vane, which may be operatively rotatable with the impeller or stationarily fixed to the pump housing, provides axially-directed feeding of suspension through the inlet channel toward the working vanes, concurrent with fluidizing of suspension in the channel by the impeller blade, thereby effectively preventing reverse flow of suspension in the inlet channel and correspondingly increasing the operating efficiency of the centrifugal pump.

18 Claims, 3 Drawing Sheets

FLUIDIZING CENTRIFUGAL PUMP

FIELD OF THE INVENTION

The present invention relates to centrifugal pumps and, more particular, to improvements in centrifugal fluidizing pumps which are commonly used for pumping medium to high consistency fiber suspensions such as finely comminuted cellulosic fiber material suspensions—i.e. paper pulp.

BACKGROUND OF THE INVENTION

Known centrifugal pumps for medium to high consistency fiber suspensions—in the range, by way of example, of approximately 6 to 20 percent for paper pulp which is a typical application for such pumps—suffer from an inherent operational deficiency which seriously detracts from the efficient volumetric pumping of suspension material therethrough. The fluidization of the suspension by the rotating impeller blades in the inlet channel of the pump creates a strong turbulent, fluidized, annular layer of pulp adjacent the peripheral wall of the inlet channel. The suction effect of such centrifugal pumps cause this annular layer to flow substantially axially toward the working vanes in the pump interior, particularly when the pump is operating at relatively high capacity. At lower capacities, however, there develops a reverse or back flow of the fluidized pulp layer closest to the peripheral wall of the inlet channel thus decreasing volumetric flow of suspension through the centrifugal pump and correspondingly lowering the unit's operating efficiency.

It is accordingly the desideratum of the invention to provide a centrifugal pump for medium to high consistency suspension wherein reverse or back flow of suspension in the inlet channel is substantially eliminated. It is a particular object of the invention to provide such a pump in which the operating efficiency of the pump is notably increased without undue modification of the basic structure of the pump.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENTS

The present invention is directed to improvements in centrifugal pumps of the type which are commonly used for pumping medium to high consistency fiber suspensions as, for example, finely comminuted cellulosic fiber material suspensions—i.e. paper pulp. Such suspensions typically have a consistency, or pulp concentration, of between about 6 to 20 percent. The improved pump of the invention provides noteworthy increases in the operating efficiency of conventionally known fluidizing pumps of this type. Thus, increases on the order of 20% and higher in the volume of suspension being pumped are readily attainable in accordance with the invention.

Broadly, the present invention provides a modification of heretofore generally known fluidizing centrifugal pumps whereby, by reason of such modification, concurrent with fluidization of the fiber suspension received at the pump inlet the suspension is subjected to axially-directed forces which facilitate flow of the suspension into and through the pump casing or housing. Put another way, the improved centrifugal pumps of the invention provide concurrent fluidizing and axial feeding of suspension through the inlet channel of the pump and, accordingly, toward the working vanes and pump outlet. As herein described, the modification may be applied to the impeller, or to a stationary surface of the pump casing, or to both the impeller and pump casing, and/or to other elements or portions of the centrifugal pump as will become apparent to those skilled in the art with knowledge of this disclosure. In particularly preferred forms of the invention as currently contemplated, the modification is in the form of one or more spiral or thread-like surfaces which may be stationarily arranged with respect to the conventionally rotatable impeller and/or disposed for rotation with the impeller during normal operation of the pump. In either case, these spiral or thread-like surfaces function in the manner of screw conveyers which, in conjunction with concurrent fluidizing of the fiber suspension, effectively prevent the formation of flocs and substantially eliminate the reverse or back flow which is an inherent characteristic of prior art centrifugal pumps as suspension is operatively pumped through the pump casing.

Figure 1:
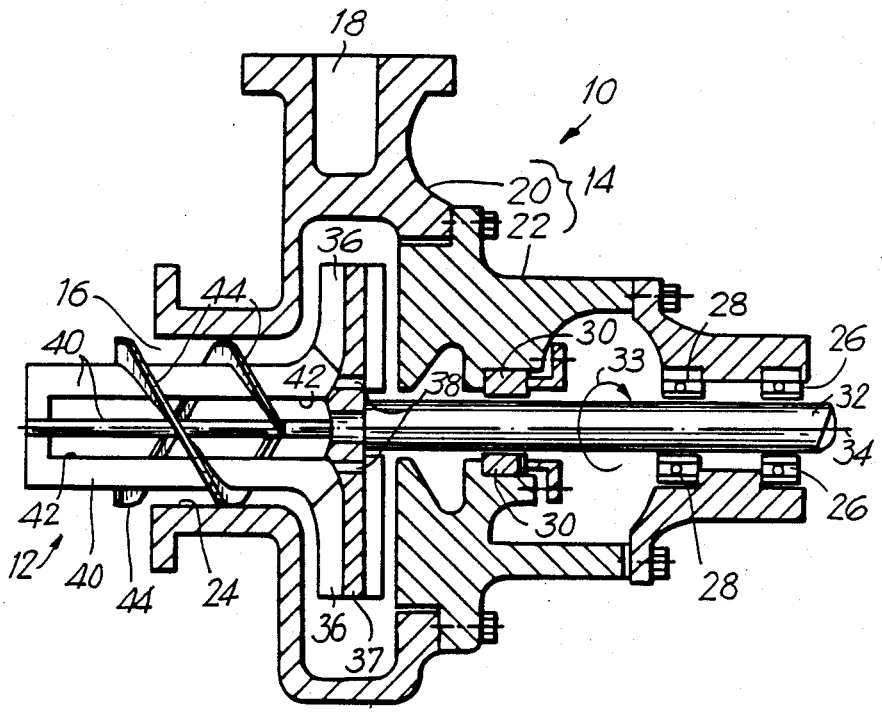
FIG. 1 is a cross-sectional view of a first embodiment of a centrifugal fluidizing pump constructed in accordance with the teachings of the invention.

An embodiment of a centrifugal fluidizing pump 10 constructed in accordance with the teachings of the present invention is depicted in FIG. 1. In this first disclosed embodiment, the improvement is applied entirely to the impeller, here designated by the general reference numeral 12. Thus, the remainder of the pump 10 may take on any known conventional or other desired form and its illustrated construction in the Figure is, accordingly, intended solely by way of example and for ease of description.

Pump 10 includes a casing or housing 14 having an inlet channel 16 at one end of the housing for receiving the suspension to be pumped, and an outlet 18 through which the suspension is forcibly discharged. Housing 14 may, if desired, be defined by an interconnected first housing part 20 and a second housing part 22 as is common in the art. Inlet channel 16, which will most commonly be substantially circular in cross-section, is bounded by an interior peripheral wall or surface 24. Wall 24 preferably, but not necessarily, has a relatively smooth face in order to facilitate the flow of suspension along and within inlet channel 16.

Pump housing 14 carries a plurality of suitable bearing means or sets 26, 28, and shaft sealing 30 for supporting an elongated, rotatable shaft 32 to which the impeller 12 is affixed or connected. Shaft 32 is driven by a motor or like driving or powering means (not shown) to operatively rotate the shaft in the direction indicated by the arrow 33 and thereby correspondingly rotate the impeller 12 for pumping suspension between the inlet channel 16 and outlet 18. The elongation or extension of rotatable shaft 32 defines the axis 34 of the pump, pump housing and impeller.

Impeller 12 includes, as is conventionally known, one or more and preferably a plurality of working vanes 36 attached to impeller back plate 37 and which are elongated generally radially outwardly from the pump axis 34 and which, with rotation of the impeller, primarily effect centrifugal pumping through outlet 18 of suspension received at inlet channel 16. The impeller back plate 37 may incorporate throughbores 38 for facilitating the removal or discharge of air that has been separated from the incoming fiber suspension during fluidizing operation of the centrifugal pump.

Impeller 12 further includes a plurality of fluidizing vanes or blades 40 disposed in and along the inlet channel 16 and extending substantially axially outwardly or forwardly from the working vanes 36. The centrifugal pump 10 of FIG. 1 includes four such fluidizing blades although only a single blade is required for effective operation of the pump in accordance with the invention and, indeed, the number of fluidizing blades incorporated in the pump is a matter of design choice generally selected, for example, on the basis of the dimensions and volumetric capacity of the pump and the intended rotational speed of the impeller. In a particularly preferred form of the impeller an opening 42, and most preferably a substantially centrally-disposed opening, is defined between respective ones of the fluidizing blades 40. The provision of opening 42 enhances the separation of air from the incoming fiber suspension during operation of the centrifugal pump 10.

Thus, the blades 40 are formed as substantially flat bars or fins arranged so as to project substantially radially outwardly from central opening 42. Nevertheless, as should be apparent the blades 40 may take on a variety of alternate configurations such, for example, as omitting central opening 42 whereby each blade will meet at and extend radially outwardly from central axis 34, or having a slight or other predetermined curvature along their widths, or having a curved or, for example, spiral configuration along their axial extensions from working vanes 36. In the latter case, the orientations of the spiral or other curvatures of the blades may be such as to effect axial feeding movement of suspension through inlet channel 16 either toward or away from the working vanes. All such arrangements, and others not expressly described herein but nonetheless apparent from this disclosure, are within the scope and contemplation of the invention.

The impeller 12 further carries, in accordance with the primary feature and enhancement of the invention, one or more feeder vanes 44 mounted or otherwise carried on and along at least a portion of the axial extension of the fluidizing blades 40. The feeder vanes 44 are disposed radially outward of the fluidizing blades and extend in and along inlet channel 16 at an angle of between approximately 1 and 89 degrees to the axis 34. In the form of the pump 10 illustrated in FIG. 1, each of a pair of feeder vanes 44 defines a substantially helical or spiral thread-like surface arranged so that, as it operatively rotates about axis 34 with the blades 40 and the remainder of impeller 12, the feeder vane acts in the manner of a screw conveyor to forcibly drive or exert an axial force on the suspension in inlet channel 16 in the direction of the working vanes 36—i.e. toward the interior of the pump and outlet 18. This axially inwardly directed force is effective to prevent and substantially eliminate the axial reverse or back flow of suspension that is an inherent characteristic of prior art centrifugal pumps, particularly (although not exclusively) at low to medium pumping capacities. The substantial elimination of this reverse flow results in a noteworthy increase in the operational efficiency of suspension pumping, typically on the order of 20 percent.

Figure 2:
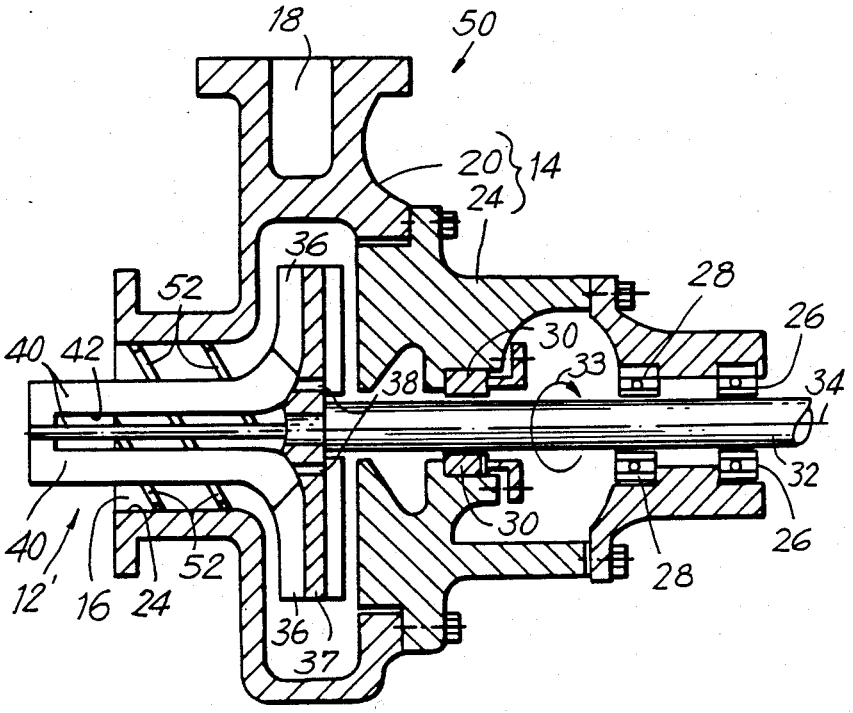
FIG. 2 is a cross-sectional view of a second embodiment of a centrifugal fluidizing pump in accordance with the invention.

A modified or second form of fluidizing centrifugal pump 50 in accordance with the invention is depicted in FIG. 2. Much of the pump 50 is or may be structurally identical, or at least closely similar, to corresponding portions of the first-described pump 10 of FIG. 1, as indicated by the like reference numerals used to identify corresponding elements thereof. The primary difference between the pumps 10 and 50 is that, in the latter, the impeller 12′ includes no feeder vanes mounted or otherwise carried on its fluidizing blades 40 or, indeed, on any portion of the impeller. Instead, one or more—two in the particular pump 50 shown in the drawing—generally spiral or helical feeder vanes 52 are stationarily mounted on and depend from the peripheral wall 24 of inlet channel 16. Thus, the vanes 52 extend from wall 24 inwardly toward the interior of the inlet channel and terminate radially outwardly from the edges of the fluidizing blades 40 to permit unimpeded rotation of the blades 40 with impeller 12′. Here, again, the feeder vanes 52 are oriented at a pitch or angle of between approximately 1 and 89 degrees to the axis or rotation 34.

During operation of the centrifugal pump 50, rotary motion, substantially about axis 34, is imparted to suspension in the inlet channel 16 by the rotation of the fluidizing impeller blades 40. As a consequence, there is relative rotary motion between the moving suspension and the stationary feeder vanes 52 whereby the vanes exert, in the manner of screw conveyors, an axially-directed force on the suspension to drive the suspension toward the working vanes 36 and pump outlet 18. In this manner, as in the pump embodiment of FIG. 1 wherein the feeder vanes 44 actually rotate with the impeller blades 40, suspension in the inlet channel 16 is, concurrently, rotated substantially about the axis 34 by the fluidizing rotation of the impeller blades 40, and driven axially along the inlet channel toward the pump interior by the stationary feeding vanes 52 as a consequence of the relative movement between the rotated suspension and the fixed vanes 52. Reverse or back flow of suspension in the inlet channel is correspondingly prevented, in this instance with particular effectiveness because the feeding vanes 52 extend to and abuttingly depend from the peripheral wall 24 immediately along which the reverse flow of suspension characteristic of prior art centrifugal pumps is most significant.

Figure 3:
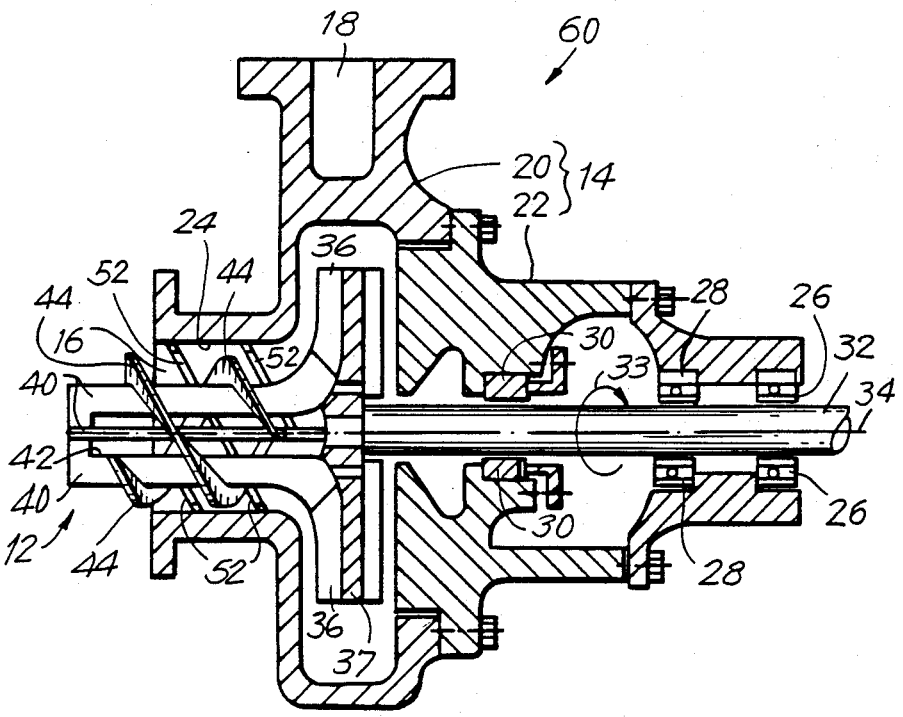
FIG. 3 is a cross-sectional view of a third embodiment of a centrifugal fluidizing pump in accordance with the invention.

Another modified form of centrifugal pump in accordance with the invention, designated by the general reference numeral 60, is depicted in FIG. 3. This third pump embodiment is, in effect, a combination of the primary structural features of the pumps 10 (FIG. 1) and 50 (FIG. 2) by which the advantageous increases in operational efficiency of each are realized. Thus, the centrifugal pump 60 includes the impeller 12 which carries one or more first or primary feeder vanes 44 mounted on and radially outwardly of the fluidizing blades 40 for operative rotation of the feeder vanes with the impeller. In addition, the pump 60 includes one or more second or secondary stationary feeder vanes 52 secured to and depending from the peripheral wall 24 of the inlet channel 16. The feeder vanes 44 and 52 are arranged and may take any of the forms hereinabove described in connection with the pumps 10 and 50, and such descriptions will not, accordingly, now be repeated. In any event, as will be appreciated the combined inclusion of rotatable feeder vanes 44 carried on the impeller 12, and of stationary feeder vanes 52 fixed to the peripheral wall 24, is particularly effective in preventing the reverse or back flow of suspension that is an inherent characteristic of prior art centrifugal pumps and, as previously pointed out, provides significant increases in operating efficiency.

While there have been shown and described and pointed out fundamental novel features of the invention as applied to several preferred embodiments thereof, it will be understood that various omissions and substitutions and changes in the form and details of the devices illustrated and in their operation may be made by those skilled in the art without departing from the spirit of the invention. It is the intention, therefore, to be limited only as indicated by the scope of the claims appended hereto.

What is claimed is:

1. A fluidizing pump for medium to high consistency fiber suspension, comprising:

a housing having an axis, an axially-extending inlet channel through which fiber suspension is received and an outlet through which fiber suspension is discharged;

an impeller operatively rotatable in said housing and comprising a working vane and a fluidizing blade extending substantially axially along and in said inlet channel; and a feeder vane extending in and along said inlet channel and oriented at an angle of between approximately 1 and 89 degrees to said housing axis, said feeder vane being disposed radially outward of said fluidizing blade and extending along at least a portion of said substantially axial extension of the fluidizing blade.

2. A fluidizing pump in accordance with claim 1, wherein said feeder vane comprises a screw thread arranged for subjecting fiber suspension in said inlet channel to an axially-directed force toward said working vane for facilitating substantially axial flow of the fiber suspension along said inlet channel with operative rotation of said impeller.

3. A fluidizing pump in accordance with claim 1, wherein said impeller comprises a plurality of fluidizing blades and an axially-extending opening defined substantially centrally between respective ones of said blades.

4. A fluidizing pump in accordance with claim 1, wherein said feeder vane is mounted on and radially outwardly from said fluidizing blade for operative rotation of said feeder vane with said impeller.

5. A fluidizing pump in accordance with claim 1, wherein said inlet channel has an interior periphery and said feeder vane is mounted on said periphery.

6. A fluidizing pump in accordance with claim 5, wherein said feeder vane is stationarily mounted on said inlet channel periphery.

7. A fluidizing pump in accordance with claim 1, wherein said inlet channel has an interior periphery and said feeder vane comprises a primary feeder vane disposed for operative rotation with said impeller.

8. A fluidizing pump in accordance with claim 7, wherein said pump further comprises a secondary feeder vane mounted on said inlet channel periphery.

9. A fluidizing pump in accordance with claim 8, wherein said secondary feeder vane is stationarily mounted on said inlet channel periphery.

10. A fluidizing pump in accordance with claim 9, wherein said primary feeder vane is mounted on said fluidizing blade.

11. An impeller for a fluidizing pump for medium to high consistency fiber suspension, said impeller having an axis about which said impeller is operatively rotatable, comprising:

a working vane;

a fluidizing blade extending substantially axially-outwardly from said working vane; and a feeder vane mounted on and radially outwardly of said fluidizing blade and extending along at least a portion of the axial extension of said blade, said feeder blade being oriented at an angle of between approximately 1 and 89 degrees to said impeller axis for facilitating substantially axially-directed flow of fiber suspension in the pump toward said working vane.

12. An impeller in accordance with claim 11, wherein said feeder vane comprises a screw thread.

13. An impeller in accordance with claim 11, further comprising a plurality of fluidizing blades and an axially-extending opening defined between respective ones of said blades.

14. An impeller in accordance with claim 11, further comprising a plurality of fluidizing blades and an axially-extending opening defined substantially between respective ones of said blades.

15. An impeller in accordance with claim 11, further comprising a plurality of feeder vanes mounted on and radially outwardly of said fluidizing blade.

16. An impeller in accordance with claim 11, further comprising a plurality of fluidizing blades and a plurality of feeder vanes mounted on and radially outwardly of said plural fluidizing blades.

17. An impeller in accordance with claim 16, further comprising an axially-extending opening defined between respective ones of said blades.

18. An impeller in accordance with claim 16, further comprising an axially-extending opening defined substantially centrally between respective ones of said blades.

* * * * *